US005884767A

United States Patent [19]

Peng

[11] Patent Number: 5,884,767

[45] Date of Patent: Mar. 23, 1999

[54] KEYPAD PACKING BOX

[75] Inventor: Jeffery Peng, Taipei Hsien, Taiwan

[73] Assignee: Chicony Electronics Co., Ltd, Taipei Hsien, Taiwan

[21] Appl. No.: 985,187

[22] Filed: Dec. 4, 1997

[51] Int. Cl.[6] ..... B65D 5/50; B65D 85/00

[52] U.S. Cl. ..... 206/485; 206/320; 206/756; 206/762

[58] Field of Search ..... 206/305, 320, 206/485, 784, 759, 760, 762, 763, 45.2, 45.21, 45.24, 45.12, 45.18, 756

[56] References Cited

U.S. PATENT DOCUMENTS

| | | | |
|---|---|---|---|
| 3,314,530 | 4/1967 | Michalke | 206/756 |
| 3,645,382 | 2/1972 | Abrams | 206/45.21 |
| 4,070,489 | 1/1978 | Pahnke | 206/45.2 X |
| 4,230,258 | 10/1980 | Lane | 206/589 X |
| 4,450,965 | 5/1984 | Paillet | 206/485 X |
| 5,188,223 | 2/1993 | Brose et al. | 206/760 |
| 5,494,166 | 2/1996 | Kuwata et al. | 206/485 X |

FOREIGN PATENT DOCUMENTS

| | | | |
|---|---|---|---|
| 2658787 | 8/1991 | France | 206/485 |
| 4024112 | 2/1992 | Germany | 206/485 |
| 683090 | 1/1994 | Switzerland | 206/485 |
| 700416 | 12/1953 | United Kingdom | 206/45.18 |

*Primary Examiner*—Bryon P. Gehman
*Attorney, Agent, or Firm*—Rosenberg, Klein & Bilker

[57] ABSTRACT

A keypad packing box made by cutting a substantially rectangular base board into a design, permitting the cut rectangular base board to be folded up into a double bevel configuration for holding individually packed keypads at two sides for exhibition.

4 Claims, 5 Drawing Sheets

KEYPAD PACKING BOX

BACKGROUND OF THE INVENTION

The present invention relates to packing boxes for packing keypads, and more particularly to such a keypad packing box which is made by cutting a substantially rectangular base board into a design and then folding up the cut rectangular base board into shape.

When individual keypads are packed in individual blister cards, they are packed in a packing box. Regular packing boxes designed for this purpose can only be used for packing keypads for transport. These packing boxes cannot be used as exhibition means to show packed items in retail stores, shops, etc.

SUMMARY OF THE INVENTION

The present invention provides a keypad packing box which can be used as exhibition means to show packed items. A keypad packing box according to the invention is made by cutting a substantially rectangular base board into a design and then folding up the cut rectangular base board into shape. The base board comprises a first folding line transversely disposed on the middle, two first bottom panels separated by the first folding line, the first bottom panels having at least one respective pair of retainer strips adapted for securing the first bottom panels in a double bevel configuration, two first side panels, two second folding lines disposed in parallel to the first folding line at two opposite sides between the first bottom panels and the first side panels, two top panels respectively connected to the first side panels at two opposite sides, two third folding lines disposed in parallel to the second folding line at two opposite sides between the first side panels and the top panels, a plurality of plug holes respectively disposed at the top panels and spaced along the third folding lines, two second bottom panels respectively connected to the top panels at an outer side opposite to the first side panels and adapted to partially cover over the first bottom panel, each of the top panels is positionally disposed adjacent a respective one of the bottom panels, and is connected thereto by a respective series of linearly spaced sectional links, each one of the sectional lines being formed between an adjacent pair of linearly spaced U-cuts through the respective one of the top panels, two reinforcing flaps respectively connected to the second bottom panels at an outer side opposite to the top panels and adapted to support the first side panels at an inner side, two fourth folding lines disposed in parallel to the third folding lines at an outer side between the reinforcing flaps and the second bottom panels, and a plurality of plug strips respectively extended from the reinforcing flaps at an outer side opposite to the second bottom panels and adapted for fastening to the plug holes.

DETAILED DESCRIPTION OF THE PREFERRED EMBODIMENT

Figure 1:
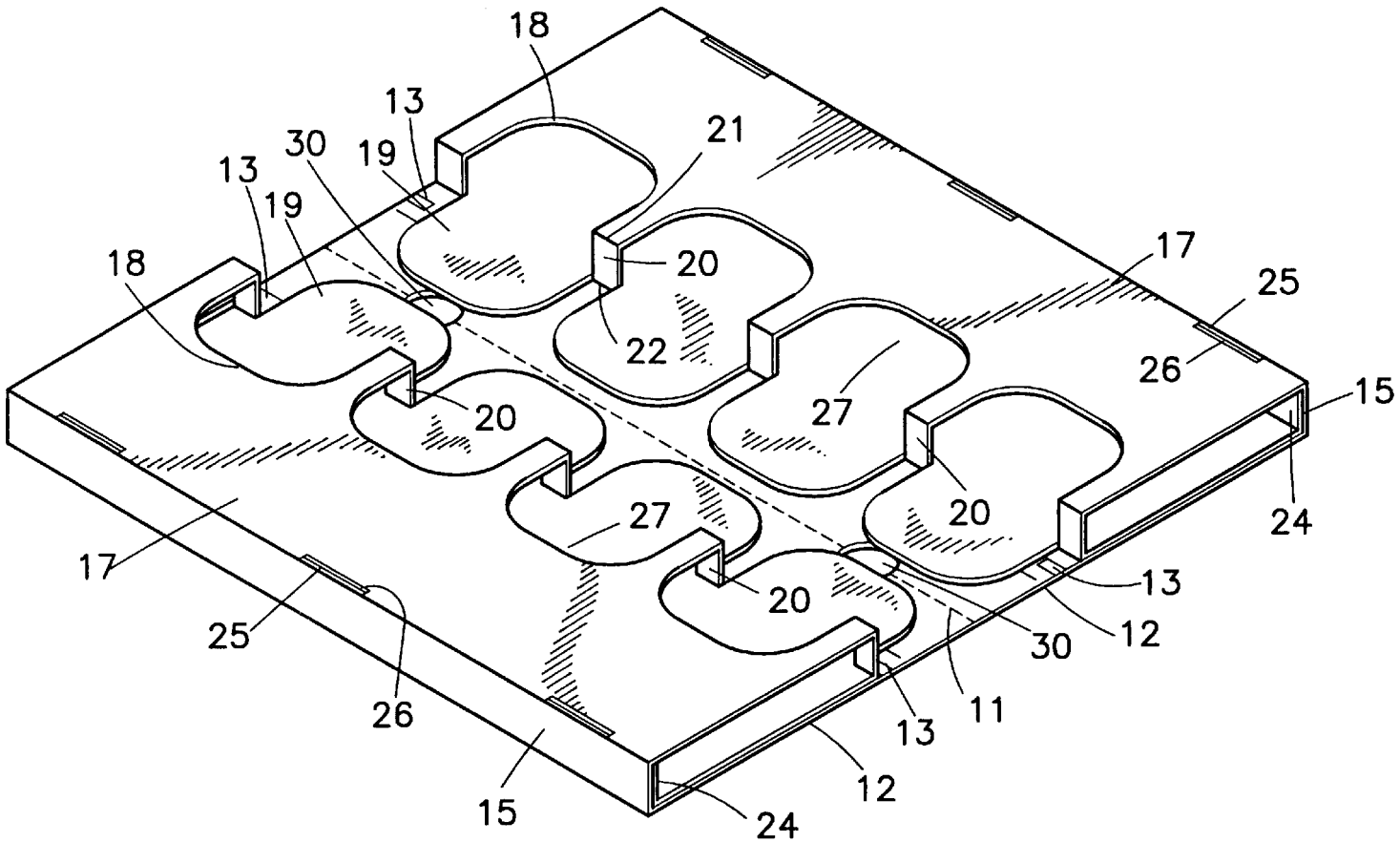
FIG. 1 is a perspective view of a keypad packing box when set in a flat manner according to the present invention.
Figure 2:
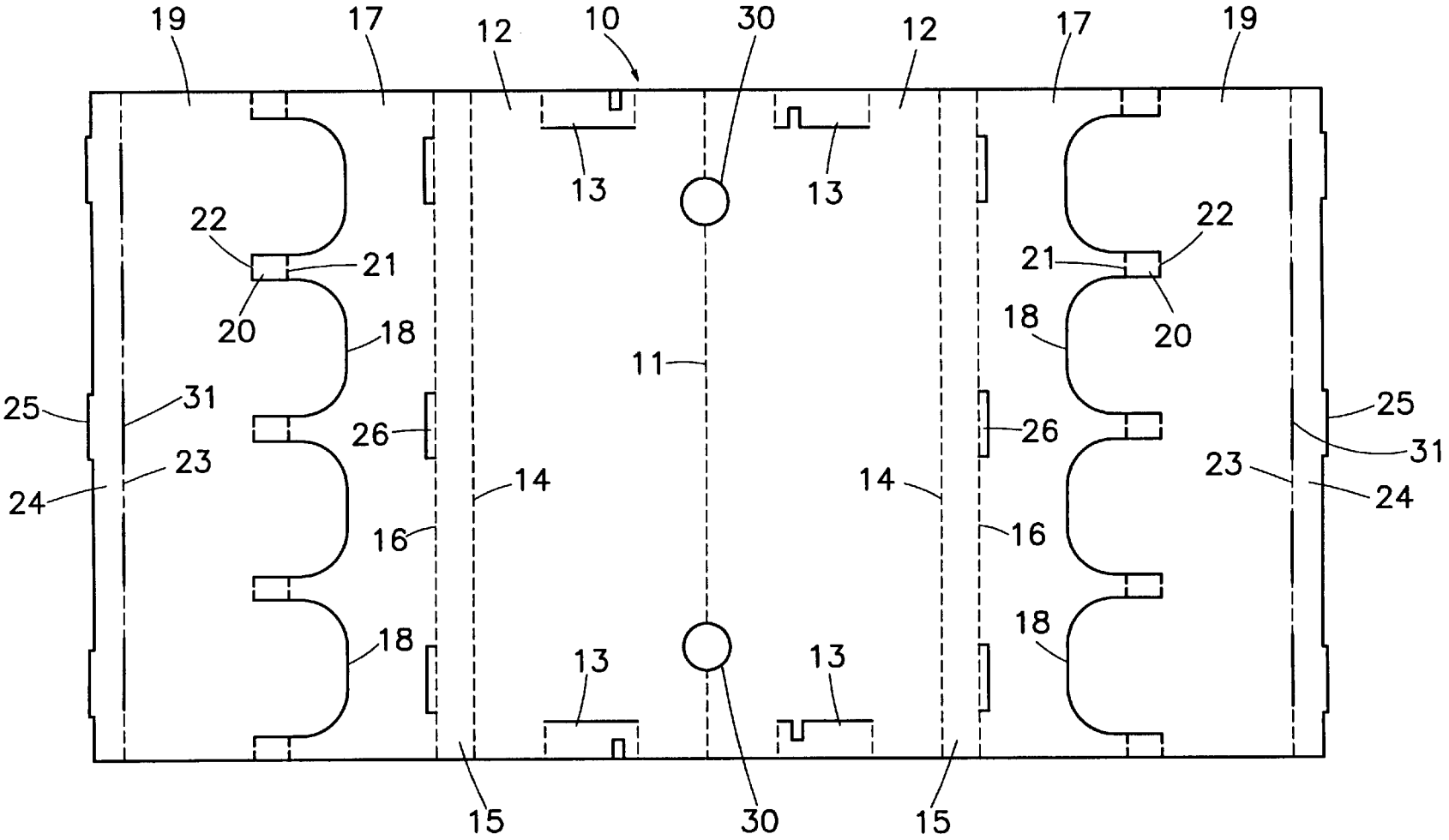
FIG. 2 is an extended out view of the keypad packing box shown in FIG. 1.

Referring to FIGS. 1 and 2, a keypad packing box in accordance with the present invention is cut from a cardboard into a substantially rectangular base board 10 (see FIG. 2), and then folded up into shape (see FIG. 1).

The base board 10 comprises a first folding line 11 transversely disposed on the middle, a plurality of for example two through holes 30 spaced at the first folding line 11, two first bottom panels 12 separated by the first folding line 11, the first bottom panels 12 having at least one respective pair of retainer strips 13 adapted to secure the first bottom panels 12 in a double bevel configuration (see FIG. 5) for exhibition, two first side panels 15, two second folding lines 14 disposed in parallel to the first folding line 11 at two opposite sides between the first bottom panels 12 and the first side panels 15, two top panels 17 respectively connected to the first side panels 15 at two opposite sides, two third folding lines 16 disposed in parallel to the second folding line 14 at two opposite sides between the first side panels 15 and the top panels 17, a plurality of plug holes 26 respectively disposed at the top panels 17 and spaced along the third folding lines 26, two second bottom panels 19 respectively connected to the top panels 17 at an outer side opposite to the first side panels 15, each of the top panels 17 is positionally disposed adjacent a respective one of the second bottom panels 19, and is connected thereto by a respective series of linearly spaced sectional links 20, each one of the sectional links being formed between an adjacent pair of linearly spaced U-cuts 18 through the respective one of the adjacent top panels 17, and each of the sectional links 20 extending between a folding line 21 of the top panel and a folding line 22 of the second bottom panel, two reinforcing flaps 24 respectively connected to the second bottom panels 19 at an outer side opposite to the top panels 17 and adapted to reinforce the first side panels 15, two fourth folding lines 23 disposed in parallel to the third folding lines 16 at an outer side between the reinforcing flaps 24 and the second bottom panels 19, a plurality of elongated cuts 31 aligned at the fourth folding lines 23, the elongated cuts 31 making the folding of the reinforcing flaps 24 easy, and a plurality of plug strips 25 respectively extended from the reinforcing flaps 24 at an outer side opposite to the second bottom panels 19 and adapted for fastening to the plug holes 26.

Figure 3:
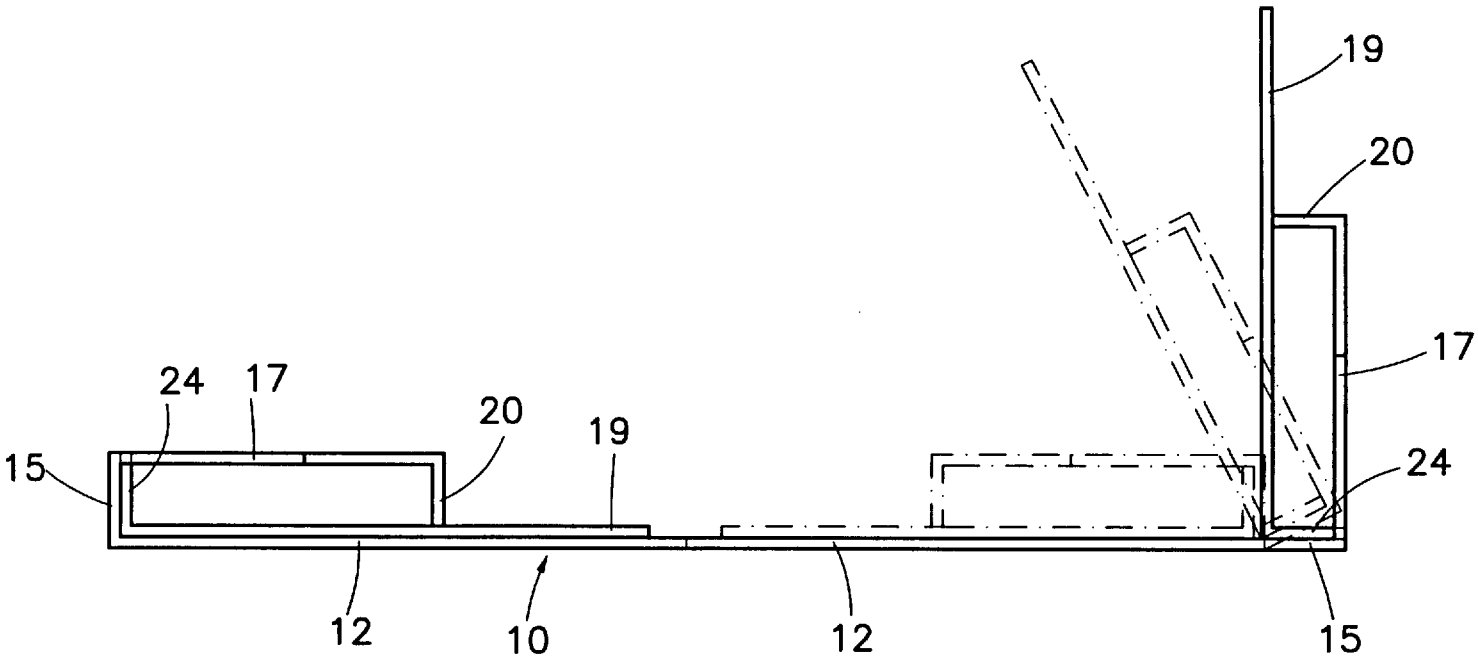
FIG. 3 shows the rectangular base board folded up into shape according to the present invention.

Referring to FIG. 3 and FIGS. 1 and 2 again, the first side panels 15 are folded into a vertical position perpendicular to the first bottom panels, each series of sectional links is folded into a vertical position and disposed in parallel to the first side panels 15, the reinforcing flaps 24 are respectively attached to the first side panels 15 at an inner side and secured in place by fastening the respective plug strips 25 to the respective plug holes 26. After the base board 10 has been folded up into shape as shown in FIG. 1, two rows of receiving chambers 27 are defined between the top panel 17, the first bottom panels 12 and the second bottom panels 19.

Figure 4:
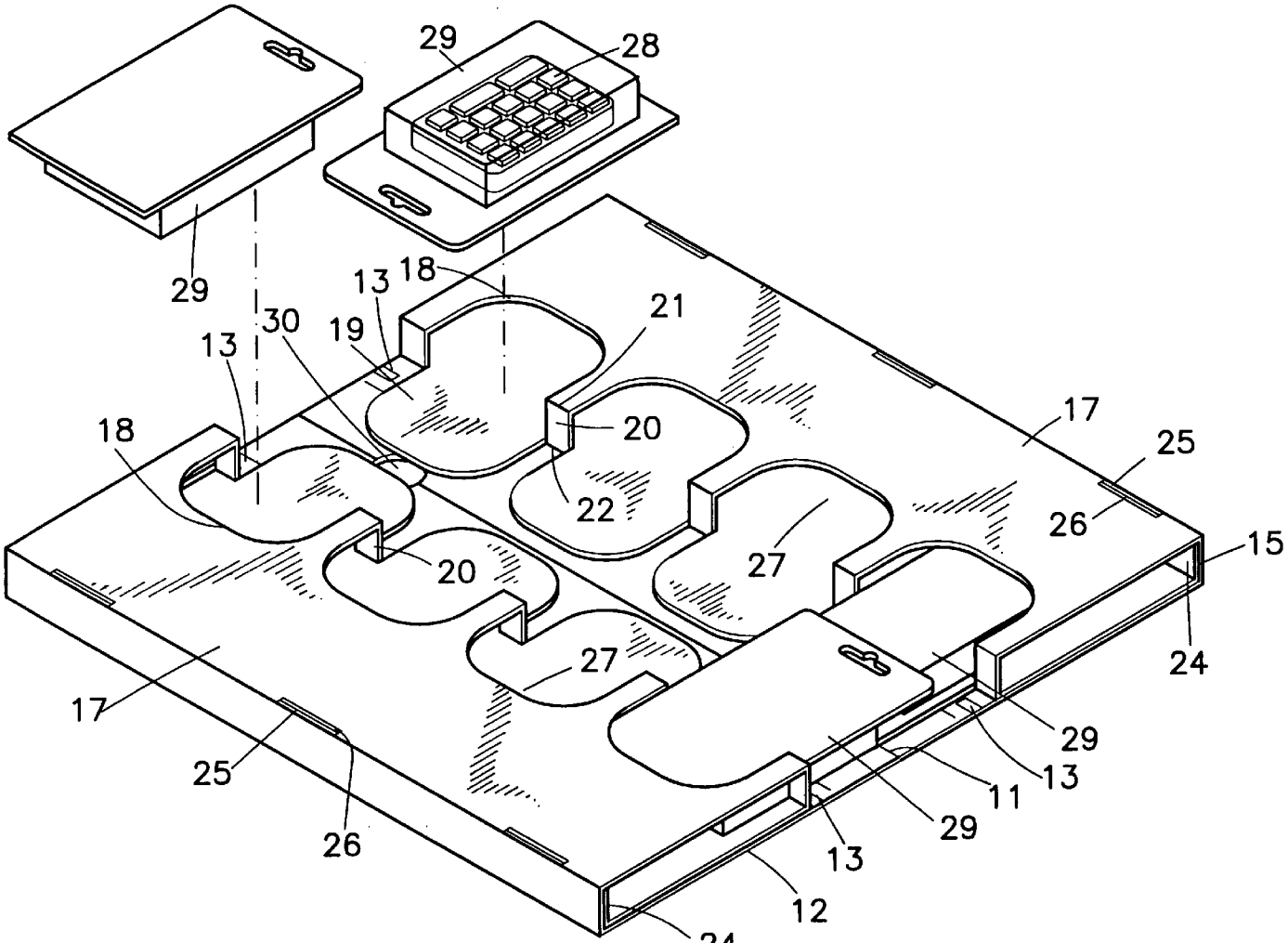
FIG. 4 shows the positioning of keypads in the keypad packing box according to the present invention.

Referring to FIG. 4, keypads 28 are packed in a respective individual blister card 29, and then respectively mounted in the receiving chambers 27.

Figure 5:
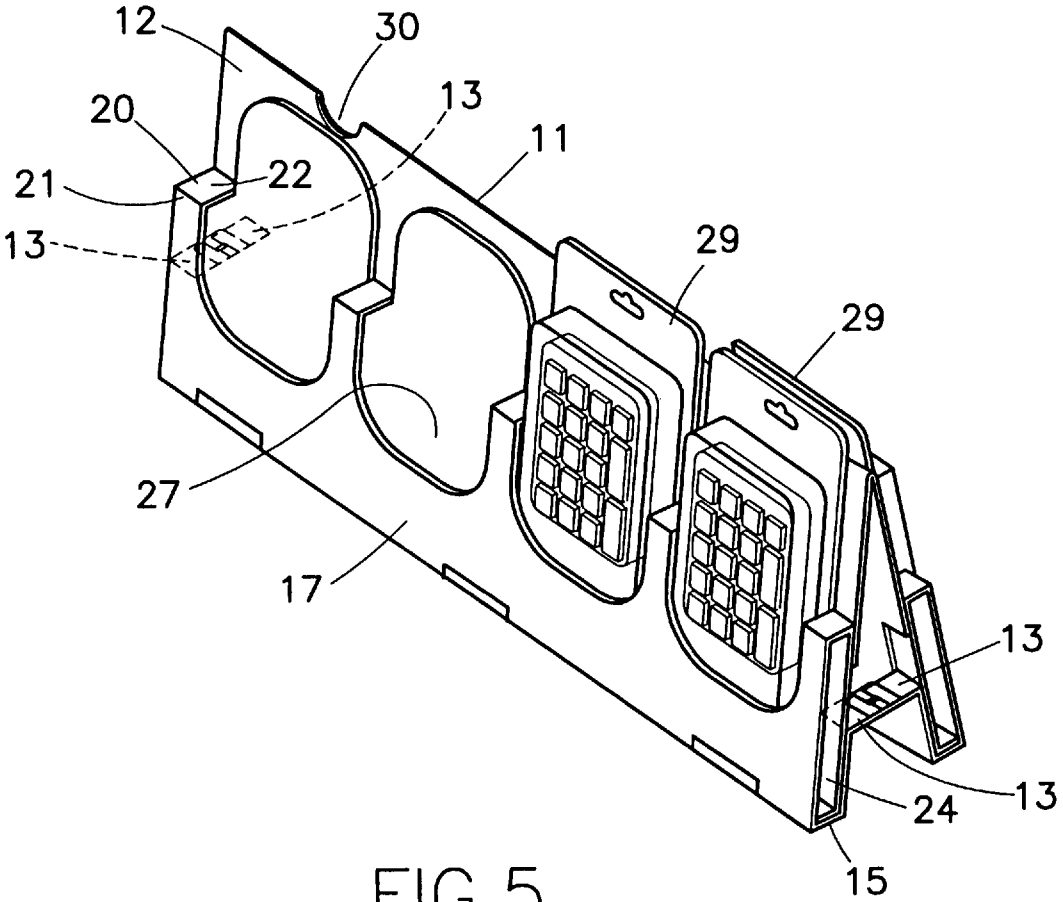
FIG. 5 shows the keypad packing box arranged into a double bevel configuration for exhibition.

Referring to FIG. 5, the keypad packing box can be folded up along the first folding line 11 into a double bevel configuration to show the storage items, and secured in shape by fastening the retainer strips 13 of the first bottom panels 12 together.

It is to be understood that the drawings are designed for purposes of illustration only, and are not intended as a definition of the limits and scope of the invention disclosed.

What the invention claimed is:

1. A keypad packing box, comprising:

a substantially rectangular base board divided medially at a transverse first fold-line thereof into a pair of opposing substantially identical sections, each of said substantially identical sections including a first bottom panel extending between said medial first fold-line and a transverse second fold-line, said first bottom panel including a pair of retaining strips therein;

a first side panel extending between said second fold-line and a transverse third fold-line;

a top panel connected to said first panel along said third fold-line, said top panel having a plurality of plug holes formed therethrough along said third fold-line and in spaced relation each to the other;

a second bottom panel positionally disposed adjacent said top panel and being connected thereto by a series of transversely spaced sectional links, each sectional link being formed between an adjacent pair of transversely spaced U-cuts through said top panel; and, a reinforcing flap extending between a transverse fourth fold-line provided at an outer edge of said second bottom panel and a terminal edge of said base board, said reinforcing flap having a plurality of plug strips provided at said terminal end for engaging respectively said plurality of plug holes formed through said top panel, whereby a series of receiving chambers are constructed in each said identical section of said base board by folding thereof along said first, second, third and fourth fold lines.

2. The keypad packing box as recited in claim 1 where said opposing pair of first bottom panels are fastened together by respective opposing pairs of said retaining strips to form a double beveled configuration when said base board is folded along said medial first fold line thereof.

3. The keypad packing box as recited in claim 1 where each said identical section further includes a plurality of through holes therein spaced along said first fold-line.

4. The keypad packing box as recited in claim 1 where each said identical section further includes a plurality of elongated cuts aligned with said fourth folding line.

* * * * *